United States Patent [19]

Perr

[11] Patent Number: 5,002,022

[45] Date of Patent: Mar. 26, 1991

[54] VALVE CONTROL SYSTEM WITH A VARIABLE TIMING HYDRAULIC LINK

[75] Inventor: Julius P. Perr, Columbus, Ind.

[73] Assignee: Cummins Engine Company, Inc., Columbus, Ind.

[21] Appl. No.: 400,705

[22] Filed: Aug. 30, 1989

[51] Int. Cl.[5] ..... F01L 9/02; F01L 1/34

[52] U.S. Cl. ..... 123/90.12; 123/90.16

[58] Field of Search ..... 123/90.12, 90.13, 90.16, 123/90.48, 90.55

[56] References Cited

U.S. PATENT DOCUMENTS

| | | | |
|---|---|---|---|
| 3,817,228 | 6/1974 | Bywater | 123/90.16 |
| 3,921,609 | 11/1975 | Rhoads | 123/90.55 |
| 4,164,197 | 8/1979 | Nelson | 116/227 |
| 4,258,671 | 3/1981 | Takizawa et al. | 123/90.16 |
| 4,291,652 | 9/1981 | Trzoska | 123/90.55 |
| 4,466,390 | 8/1984 | Babitzka et al. | 123/90.12 |
| 4,664,070 | 5/1987 | Meistrick et al. | 123/90.13 |
| 4,674,451 | 6/1987 | Rembold et al. | 123/90.16 |
| 4,696,265 | 9/1987 | Nohira | 123/90.16 |
| 4,716,863 | 1/1988 | Pruzan | 123/90.12 |
| 4,765,288 | 8/1988 | Linder et al. | 123/90.16 |
| 4,892,067 | 1/1990 | Paul et al. | 123/90.16 |

FOREIGN PATENT DOCUMENTS

| | | | |
|---|---|---|---|
| 2926327 | 1/1981 | Fed. Rep. of Germany | 123/90.12 |
| 3807699 | 9/1989 | Fed. Rep. of Germany | 123/90.12 |
| 2027486 | 2/1980 | United Kingdom | 123/90.12 |
| 2032005 | 4/1980 | United Kingdom | 123/90.12 |

*Primary Examiner*—Charles J. Myhre
*Assistant Examiner*—Weilun Lo
*Attorney, Agent, or Firm*—Sixbey, Friedman, Leedom & Ferguson

[57] ABSTRACT

A valve tappet and control system is provided including expansible and collapsible hydraulic link; wherein the control system causes expansion of the hydraulic link and determines the timing of the collapse and thus the closing of an intake valve of an internal combustion engine. The timing is variable depending on engine operating conditions, such as output power and turbo charger boost pressure. In one embodiment, a rotary valve and fluid gating device is used to connect a pressure line used to expand the hydraulic link to a dump line at one instance during each cam shaft rotation to provide the early closing of the valve. In a second embodiment, a rotary cam follower with an oblique surface is used, wherein the orientations of the oblique surface is the determinative feature that is controlled to change early closing time as well as a delayed opening. A third embodiment utilizes a separate drain line from the hydraulic link that is opened by an electromagnetic solenoid controlled by a distributor system with a time variable adjustment.

14 Claims, 3 Drawing Sheets

VALVE CONTROL SYSTEM WITH A VARIABLE TIMING HYDRAULIC LINK

TECHNICAL FIELD

The present invention relates generally to a valve tappet mechanism including a hydraulic link with a control system so that the closing time of a intake valve of an internal combustion engine can be variably controlled to close earlier in its cycle than would be permitted by a conventional cam shaft. Particularly, a mechanism is provided for permitting collapsing of the hydraulic link within the tappet assembly by opening the hydraulic link to a lower pressure line at a variable point before the valve would close normally. The timing of the collapsing of the hydraulic link and thus the early closing of the valve is determined to close earlier in the cycle as output power and turbo charger boost pressure increase.

BACKGROUND OF THE INVENTION

Valve control systems for internal combustion engines that provide for early closing, and thus a shorter open time, of a valve are known in the prior art. An example of an electro-hydraulic valve control system is disclosed by Babitzka et al., U.S. Pat. No. 4,466,390. In the Babitzka et al. system, a hydraulic plug is maintained between a cam follower and a piston by a series of springs, wherein the hydraulic plug is connected to a pressure fluid line and to a drain line controlled by a piezoelectric column to open the drain and provide for closing action of the valve under operation of the valve spring. One such piezoelectric column is provided for each valve and they are altogether connected to an electronic control unit, and the electronic control unit signals the piezoelectric column to clamp or unclamp a sliding valve within the drain line for selective opening of the drain.

The Babitzka et al. system is disadvantageous in that the operation of the control system relies on spring pressure to close the drain line, and that the piezoelectric column must clamp the sliding valve in position by frictionally engaging a portion of the valve to hold the valve against pressure created within the hydraulic plug. Foreign substances and materials thus become much more likely to interfere with proper operation of the clamping function of the piezoelectric column. Moreover, the fully extended operational length of the cam follower, hydraulic plug, and piston is set by counteracting springs that include one between the piston and cam follower and another acting on the piston in an opposite direction. Thus, stop elements are required to maintain proper operational length between the cam shaft and valve stem. The result is that the tappet mechanism for transferring reciprocal movement from the cam shaft to the valve is unnecessarily complex and subject to fatigue and failure, as well as is the control system for operation of the drain line. Furthermore, the control system requires that each valve of the internal combustion engine controlled for early closing, such as all of the intake valves, must be independently associated with a piezoelectric column and drain valve, wherein the electronic control unit independently sends signals to the piezoelectric columns depending on engine conditions. Thus, the control system is again increased in complexity without a simple means for varying the open time and closing action of the valves together.

A mechanical-hydraulic control system is also known and disclosed in the German patent DE-OS2926327. Disclosed in the German patent is a system for translating reciprocal movement from a cam shaft to a valve stem by way of a cam follower and piston separated by a hydraulic plug. In this case, the hydraulic plug is connected to a drain to permit early closing of a valve before the valve would normally close under the influence of the cam shaft alone by a rotary slider that is driven from the cam shaft of the engine. The rotary slider is arranged so that its angular position with respect to a predetermined angle or reference position of the cam shaft can be changed within a limited range. This changing of the angular position to the predetermined angle or reference position of the cam shaft makes the early closing time somewhat variable; however, the degree of variance is disadvantageously limited in the German reference by the manner in which the angular position can be changed. Specifically, an eccentric element is used to act against a transfer element drivingly connected between the cam shaft and the rotary slider. This allows for only a small degree of change of the angular position of the rotary slider.

Moreover, the control system and valve device of the German patent are disadvantageous for the same reasons amplified above with respect to the Babitzka et al. patent, because the valve control depends on at least two springs which maintain the spacing of the hydraulic plug by spacing the cam follower and piston from one another, as well as requiring stop positional elements for the piston. The resultant structure is unnecessarily complex for the translation of reciprocal movement, and is insufficiently variable with respect to timing of the early closing of the valve in each cycle.

In another variable valve lifter arrangement disclosed in U.S. Pat. No. 3,817,228 to Bywater, a control unit is described with a piston and a sliding cylinder, wherein fluid flow from a space between the cylinder and piston is regulated to vary the length of the lifter The lifter device, however, does not provide for early closing of the valve but allows the lift to be varied. This disadvantageously reduces the entire open area of the valve and limits the opening for a sufficient amount of air fuel mixture to pass through.

Other hydraulic valve tappet mechanisms having the ability to compensate tappet length with regard to specific engine characteristics are also known in the prior art. These type devices generally include a movable tappet having a movable piston portion slidable therein with a hydraulic fluid reservoir operatively between the piston and tappet. Functionally, these devices rely on the pressure of hydraulic fluid provided within the space and any accompanying bleeder or drain passages, wherein different pressures of the hydraulic fluid provide for different length adjustments of the tappet mechanism assembly. For instance, in U.S. Pat. No. 3,921,609 to Rhoads, the tappet mechanism utilizes an oil bleed passageway leading to the pressure chamber of the tappet to prevent the lifter from pumping up to a fully solid condition at low speeds; however, the passageway is designed narrow enough to become substantially inoperative at high speeds to produce effectively solid lifter action. In U.S. Pat. No. 4,291,652 to Trzoska, a hydraulic reservoir within the tappet is provided in communication with pressure oil ports such that the pressure chamber selectively is closed or open to the reservoir, wherein the closing or opening of the pressure chamber is controlled by the relative positions of a cylinder and lower piston. U.S. Pat. No. 4.164,917 to Glasson provides a hydraulic tappet with a lash adjustment, as is common in practically all hydraulic tappets, and which further is designed to respond to a control pressure supplied to a hydraulic reservoir depending on whether the internal combustion engine is operated at a power mode or a braking mode. None of these hydraulic tappet mechanisms, however, can operate to open a valve to an operating length and then shorten the open time by permitting an early closing of the hydraulic tappet. Moreover, there is no means to permit a hydraulic link or reservoir to cause an early collapse of the tappet mechanism during a cycle.

In short, the prior art has failed to show a simple and highly accurate means to control a valve tappet mechanism without the need for complex spring and stop arrangements and that can quickly respond to variations in valve closing timing responsive to changing engine conditions. Moreover, the prior art has failed to show a control system that can vary the open time of the tappet mechanism over a relatively wide range of closing times, while also being able to control the timing of all of the tappet mechanisms associated with each cylinder of an internal combustion engine by a single operation.

SUMMARY OF THE INVENTION

Thus, it is an object of the present invention to provide a valve tappet mechanism and control system which overcomes the deficiencies of the prior art.

It is a further object to provide a hydraulically expansible and collapsible valve tappet mechanism, wherein the tappet mechanism is expanded to its operational length accurately by hydraulic pressure, and the hydraulic length is precisely collapsed to permit early closing of an intake valve in accordance with engine operating conditions.

It is another object to provide a control system to the valve tappet mechanism to control the expansion and collapse of the valve tappet mechanism in accordance with the engine operating conditions, wherein the valve closing time can be varied quickly and accurately by changing the timing of collapse of a hydraulic link of the valve tappet mechanism.

It is yet another object to provide a control system that can effectively change the closing time of all of the intake valves of an internal combustion engine at the same time so that the engine operating conditions are quickly relayed to all of the cylinders.

It is yet another object to provide the variable closing time to all of the intake valves of an internal combustion engine at the same time over a relatively wide range of early closing times so that the closing of the intake valve is more responsive to particular engine operating conditions. Such engine operating conditions include output power and turbo charger boost pressure, and the control system varies the timing of the valve closing to close earlier in the cycle as the output power and boost pressure are increased.

A valve tappet mechanism and control system designed in accordance with the present invention advantageously results in the decrease of engine cycle temperatures, as well as an increase in fuel economy due to the savings of fuel associated with early closing of the intake valves. Since cycle temperatures can be decreased by the early closing of the intake valve, resulting from less fuel in the cylinder, the cooling requirements and thermal stresses on the engine are likewise reduced. Moreover, the early closing benefits emission control in the reduction of $NO_2$ and the reduction of unburned fuel that is associated with an intake cycle that overlaps into the compression stroke of an engine cycle. Furthermore, because the closing time is variable over a relatively wide range of timing, it is possible to only have early closing during the engine operating conditions that would be benefited thereby, while providing for a graduated early closing depending on changing conditions. Particularly, early closing would not be utilized at engine idle or low fueling conditions. However, at high power conditions requiring high fueling, the early closing become increasingly more beneficial.

In order to achieve the above noted objects and advantages, a number of embodiments are provided of a valve tappet mechanism including an expansible and collapsible hydraulic link, wherein a control system determines the variable timing of the collapse and thus closing of an intake valve in accordance with the engine operating conditions. The control system operates in response to a controlling and sensing means that determines closing timing pursuant to the sensed engine conditions, such as power requirements and turbo charger boost pressures (other sensors such as temperatures, speed, and throttle can also be utilized), whereby the control system is manipulated to change the timing of collapse of the hydraulic link of the valve tappet mechanism.

In one embodiment, a gating mechanism is included that is rotationally driven at a like speed as the cam shaft controlling the opening and closing of the intake valve, wherein the gating mechanism opens the hydraulic link within the valve tappet mechanism once during each rotation of the cam shaft and reciprocal movement of the valve tappet mechanism. Also, a means is provided to vary the closing time by rotating a portion of the gating mechanism that is stationary relative to a rotating gating valve to change the closing timing. The means for turning the stationary member is appropriately connected to the controlling and sensing means.

In a second embodiment, the valve tappet mechanism includes a cam follower and a piston separated by the hydraulic link, wherein the cam follower includes an oblique surface thereon, oblique to the longitudinal axis of the cam follower, for controlling the opening and closing of a hydraulic fluid line to control expansion and collapse of the hydraulic link. The oblique surface changes the opening and closing of the hydraulic line depending on its relative rotational position, which is appropriately controlled by a drive mechanism that is operatively connected with the controlling and sensing means to change closing timing depending on the engine conditions.

In a third embodiment, a cam follower and piston separated by a hydraulic link are also used, wherein the hydraulic link is collapsed by way of a drain line separate from a supply line that is controlled by an electrical solenoid. One solenoid is associated with each valve tappet mechanism for each cylinder of an internal combustion engine and a single distributor cam is utilized to provide electrical power through a distributor and rotor device that selectively activates the solenoids in accordance with the desired closing time for each cylinder. Such a system makes it possible to concurrently adjust the closing time of the valve tappet mechanisms of each cylinder by a single adjustment operatively controlled by the controlling and sensing means.

These and other objects, features, and advantages of the present invention will become more apparent from the following description when taken in conjunction with the accompanying drawings which show, for the purposes of illustration only, plural embodiments in accordance with the present invention.

DETAILED DESCRIPTION OF THE PREFERRED EMBODIMENTS

Figure 1:
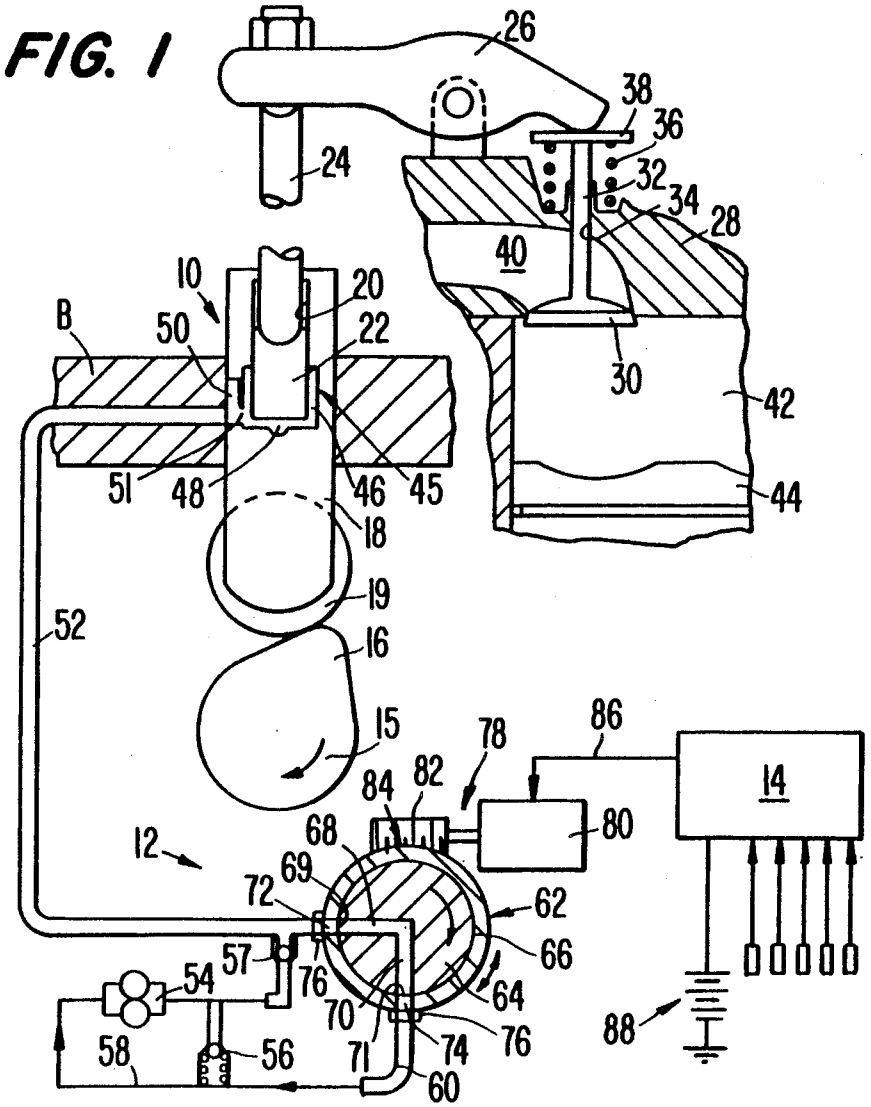
FIG. 1 is a schematic illustration of a valve tappet mechanism and control system formed in accordance with the present invention.

Referring now to the several figures and more particularly to FIG. 1, a first embodiment of the valve tappet mechanism and control system of the present invention is shown. A valve tappet mechanism 10 is provided along with a control system 12 and a controlling and sensing means 14. The valve tappet mechanism 10 is slidably retained within the block B of an internal combustion engine, which also rotatably supports a cam shaft 15 including at least one cam lobe 16. The cam shaft 15 and valve tappet mechanism 10 are conventionally provided within the engine block B so as to be supported thereby, and the cam shaft 15 is appropriately driven from an engine crank shaft in a conventional manner.

The valve tappet mechanism 10 is basically comprised of a cam follower 18 having a roller 19 that follows the peripheral surface of the cam shaft 15 and is activated by the at least one cam lobe 16. The cam follower 18 is also provided with an internal cavity 20, which is preferably cylindrical in nature and open to an end of the cam follower 18 opposite the roller 19. Within the internal cavity 20, a second basic component of the valve tappet mechanism 10 is provided at piston 22. The piston 22 is slidably retained within the internal cavity 20 so as to move freely therein in the axial direction of the cam follower 18, and is subject to hydraulic fluid forces, as will be described below. The cam follower 18 is also provided with a retaining edge 21 to prevent the piston 22, once provided within the internal cavity 20, from being forced outward of the internal cavity 20. This can be done by conventional means such as an internal snap spring or the like.

The valve tappet mechanism 10 functions to translate reciprocal motion as imparted thereto by cam shaft 15 and cam lobe 16 to a push rod 24 which acts against a rocker arm 26, in turn acting on a valve 30 slidably retained within the head 28 of an internal combustion engine. Thus, it can be seen that the stroke defined by cam lobe 16 is imparted to the valve tappet mechanism 10 which in turn opens the valve 30 by a corresponding amount. The valve 30, preferably the intake valve of an internal combustion engine, is conventionally maintained within a valve guide 34 extending through the head assembly 28 and is retained by a valve spring 36 and valve retainer 38. The intake valve 30 is provided to open and close an intake passage 40 leading into one cylinder 42 of an internal combustion engine within which a conventional engine piston 44 is reciprocally provided connected with the engine crank shaft (not shown).

As described above, the valve tappet mechanism 10 translates reciprocal movement from the cam shaft 15 to an engine valve 30, and in accordance with the present invention, a hydraulic link means 45 is provided between the cam follower 18 and the piston 22 as follows. The hydraulic link means 45 is comprised of the internal cavity 20 provided within cam follower 18 permitting sliding movement of piston 22 therein, an annular chamber 46 surrounding the internal cavity 20 at the innermost portion of the internal cavity 20, a transverse groove 48 at the bottom of internal cavity 20 and within the annular chamber 46, and an axial groove 50 provided on the circumferential external surface of the cam follower 18 while being in communication with the annular chamber 46 through an opening 51. A hydraulic fluid supply line 52 is additionally provided through the block B of the internal combustion engine for supplying pressurized hydraulic fluid to the hydraulic link means 45. To do this, first, the axial groove 50 is maintained in fluidic communication with the supply line 52 throughout the distance of stroke travel of the valve tappet mechanism 10. This is done by making the axial groove 50 at least as long as the maximum stroke distance of the valve tappet mechanism 10. Then, the hydraulic fluid is communicated by way of the opening 51 into the annular chamber 46 so as to substantially surround the piston 22. The transverse groove 48 connects between the annular chamber 46 so that fluid communication is ensured with the end of the piston 22 at the innermost end of the internal cavity 20. Thus, it can be seen that hydraulic pressure provided within the annular chamber 46 will cause movement of the piston 22 away from the bottom of the internal cavity 20 to define a hydraulic link between the cam follower 18 and piston 22 when expanded. The expansion is of course subject to a limit of travel defined by the push rod 24, rocker arm 26, and valve stem 32, wherein the valve spring 36 is strong enough to maintain the valve 30 in its closed position against the expansion hydraulic pressure provided within the annular chamber 46.

Connected to the hydraulic fluid supply line 52 is the control system 12, including a hydraulic fluid reservoir and pump mechanism 54 with a pressure regulating valve 56 capable of supplying constant pressure hydraulic fluid to the valve tappet mechanism 10. In order to provide a collapsible feature to the hydraulic link 45 of the valve tappet mechanism 10, in the operation thereof as will be described below, a dump line 60 is provided that is connected to the supply line 52 by way of a fluid gating device 62. The dump line 60 being connected with the return line 58 associated with the pressure regulating valve 56 going back to the reservoir and pump 54. A check valve 57 is also provided in line 52 at a point further from the pump mechanism 54 than the regulating valve 56, but closer than the connection of line 52 to the fluid gating device 62. The check valve 57 prevents backflow of fluid, which is important to maintain the hydraulic link means 45 in its expanded state as is further explained below in the operation of the system.

The fluid gating device 62 includes a rotary valve 64 provided within a stationary member 66, wherein the rotary valve 64 is rotationally driven by the cam shaft 15 so as to rotate at the same speed as the cam shaft 15. The manner in which the cam shaft 15 drives the rotary valve 64 can be achieved by any conventional means, such as by the provision of one to one drive and driven gears (not shown) that may directly mesh or may be driven by a transfer member such as a belt or chain (also not shown). The use of a belt or chain transfer member is preferable so as to minimize backlash that may be associated with the hydraulic system acting on the cam shaft.

The rotary valve 64 is provided with a first fluid passage 68 having an inlet 69 and a second passage 70 with an outlet 71 The first and second passages 68 and 70, respectively, are shown at a 90° angle to one another; however, it is understood that any angle can be utilized so long as the supply line 52 and dump line 60 are facilitated. The purpose of the passages 68 and 70 are to connect the supply line 52 with the dump line 60 at one point, for just an instant, during each rotation of the cam shaft 15 for collapsing the hydraulic link means 45. The first passage 68 is connected to the supply line 52 through an opening 72 in the stationary member 66, and the second passage 70 is connected to the dump line 60 by way of an opening 74 in the stationary member 66. The lines 52 and 60 are preferably flexible lines that are connected to the stationary member by conventional line fittings 76 (compression or flare type).

In order to time the collapse of the hydraulic link means 45 within the valve tappet mechanism 10, it is necessary to change the timing of when the passages 68 and 70 of the rotary valve 64, which is rotationally driven at a constant speed from the cam shaft 15, communicate with the openings 72 and 74 of the stationary member 66 connected with the supply line 52 and dump line 60, respectively. Thus, by rotating the stationary member 66 with respect to the engine block B where it supports the fluid gating device 62, the timing of connection of line 52 to line 60 is varied, while the rotary valve 64 is not changed with respect to the rotation of the cam shaft 15. In order to achieve the turning of the stationary member 66 with respect to the engine block, it is necessary that the stationary member 66 is rotationally slidably mounted to the engine block. This can be done by any conventional bracket or assembly rotationally mounted to the engine block. In the preferred embodiment, the stationary member 66 is rotationally moved by a means 78, comprising a worm gear 82 driven from a stepper motor 80 fixed to the engine block and axially extending teeth on the stationary member 66, whereby rotation of the worm gear 82 causes rotational displacement of the stationary member 66.

The controlling and sensing means 14 controls the operation of the stepper motor 80 by way of an electrical wire 86, wherein the controlling and sensing means 14 connects a power source 88 to the stepper motor 80 to position the stationary member 66 at a desired location determined by the controlling and sensing means 14. In order to make its determination as to location of the stationary member 66 and thus the timing of collapse of the hydraulic link means 45, the controlling and sensing means 14 takes into account, by way of a plurality of sensors, many engine operating conditions. Some sensors that may be used include a sensor for turbo charge boost pressure 90, a sensor for vehicle load 92, a sensor for vehicle throttle position 94, a sensor for engine temperature including oil, water and ambient air, and a sensor 98 for engine speed. This list of sensors is not all inclusive but can be expanded or decreased depending on the type of engine and features thereof In particular, the turbo charge boost pressure and vehicle load are especially useful in determining timing of collapse of the hydraulic link 45 to vary opening time of the valve 30 as amplified below with regard to the operation of the valve tappet mechanism 10 and control system 12.

In operation of the FIG. 1 embodiment, the valve tappet mechanism 10 and control system 12 are provided to open an intake valve 30 to a predetermined open position, that permits closing of the intake valve 30 earlier than the valve 30 would be permitted to close by the cam lobe 16 of the cam shaft 15. This is achieved by providing an expandable and collapsible hydraulic link 45 that is controlled to provide an operational length to the valve tappet mechanism 10 which can be shortened to provide the early closing. Starting from the position just after the exhaust stroke of an internal combustion engine with the intake stroke beginning, the reciprocating piston 44 is located at its top dead center (TDC) position. As piston 44 moves from its TDC position to a bottom dead center position (BDC), the intake stroke takes place. During the intake stroke, an intake valve 30 is opened to permit communication between the air fuel mixture with an intake passage 40 to the cylinder 42 above the piston 44. The inward movement of piston 44 causing the air fuel mixture to be sucked into the cylinder 42. In order for the intake passage 40 to be opened, it is necessary that intake valve 30 be moved inward, that is toward the engine crank shaft. This is done by way of a rocker arm 26, push rod 24, valve tappet mechanism 10 and cam lobe 16 on the cam shaft 15.

At a time before cam lobe 16 approaches the roller 19 of cam follower 18 to move the valve tappet mechanism 10 upwardly, as viewed in FIG. 1, hydraulic fluid is provided through line 52 to the valve tappet mechanism 10. The hydraulic fluid enters valve tappet mechanism 10 through axial groove 50, opening 51 and into annular chamber 46. Thereafter, as facilitated by transverse groove 48, the piston 22 is moved upwardly due to the pressurized fluid within annular chamber 46 until the piston 22 is stopped by the push rod 24, rocker arm 26 and valve stem 32. The valve spring 36 ensures this position. Once the valve tappet mechanism 10 has been expanded, cam lobe 16 engages cam follower 18 causing upward movement of the cam follower 18. This movement is also transferred to the piston 22 through the expanded hydraulic link means 45 which maintains the expanded position throughout the stroke caused by the cam lobe 16 due to the pressurized fluid from supply line 52 and the check valve 57 which prevents backflow in supply line 52 and causes a hydraulic lock. When the cam lobe 16 is rotationally located to provide maximum stroke, the intake valve 30 is likewise moved to its maximum open position. The opening time of the valve 30 is constant for each stroke because the expansion of the hydraulic link means 45 occurs previous to any lifting of the valve tappet mechanism 10. Then, at any time just after the maximum stroke is defined, the intake valve 30 can be closed earlier than it would be able to close by following the cam lobe 16 by collapsing the hydraulic link means 45 and opening the hydraulic lock. Thus, the total open time of valve 30 can be limited, as closing time can be variably determined.

The early closing and collapse of the hydraulic link means 45 occurs when supply line 52 is connected to dump line 60 by the fluid gating device 62. When this occurs, the pressure in supply line 52 is reduced to an extent that the valve spring 36 forces the rocker arm 26, push rod 24 and piston 22 inward within the internal cavity 20 of the cam follower 18. The permissible distance of travel of piston 22 within cavity 20 is sufficiently long that the valve 30 can close at any position of the cam lobe 16. The supply line 52 is connected to the dump line 60 through passages 68 and 70 of fluid gating device 62. The rotary valve 64 of the fluid gating device 62 is driven at a constant like speed as the cam shaft 15 so that for each rotation of the cam shaft 15, the rotary valve 64 will connect the supply line 52 to the dump line 60 once. It is this connection during each rotation of the rotary valve 64 and cam shaft 15 that causes the collapse of the hydraulic link means 45. By varying the timing of the collapse, the timing of early closing of the valve 30 can be controlled. After the collapse, the supply line 52 once again expands the hydraulic link means 45 to its operational length.

In order to vary the timing of collapse, the stepper motor 80 controls worm gear 82 and teeth 84 of stationary member 66, so that rotation of stationary member 66 changes the angular position of the openings 72 and 74, thereby changing when the connection of supply line 52 to dump line 60 occurs. This angular position and timing is determined by the controlling and sensing means 14 in accordance with the engine operating conditions. As above, the controlling and sensing means senses turbo charger boost pressure, vehicle load, throttle position, engine speed and engine operating temperatures. It has been found that as the boost pressure and engine output requirements are increased, it is particularly useful to close the intake valve 30 earlier in time. The advantageous result is that fuel consumption is improved, while thermal losses and emissions are reduced. The result is generally a gain in engine efficiency. Moreover, it has been discovered that early closing is not particularly needed at engine idle speeds as well as part load or low fueling conditions.

A second embodiment will now be described with reference to FIG. 2, wherein not only is the valve mechanism 100 able to permit early closing of a valve, it also provides for a delayed opening. The valve tappet mechanism 100 is basically comprised of a cam follower 102 and a piston 104 provided with a hydraulic link means 106 therebetween. The movement of the piston 104 and cam follower 102 is facilitated by a cylindrical bore 108 provided within the engine block B of an internal combustion engine. Moreover, the cylindrical bore 108 defines with the piston 104 and an oblique surface 110 of the cam follower 102 the hydraulic link means 106. The oblique surface 110 is a generally planar surface provided on the cam follower 102 that is oblique to the central axis of the cam follower 102. This oblique surface 110 determines the opening and closing timing of a valve as will be understood more clearly below. Also provided on the cam follower 102 is a spacer 112 that ensures the formation of the hydraulic link means 106 between the piston 104 and oblique surface 110, by acting as a stop limit of inward movement of the piston 104 within the cylindrical bore 108. A hydraulic fluid supply line 114 is provided to communicate through opening 116 with the bore 108 in the region of formation of the hydraulic link means 106. The positioning of opening 116 of the supply line 114 is of particular importance with respect to the opening and closing thereof by the cam follower 102 as determined by the position of the oblique surface 110. It can be seen that as the cam follower 102 is rotationally moved within the bore 108, the timing at which the cam follower 102 will block opening 116 of supply line 114 is determined by the rotary position of the oblique surface 110. In other words, every rotational increment of the cam follower 102 determines a different opening and closing time of the supply line 114.

In order to achieve this rotational movement, axially extending teeth 118 are provided on the external circumference of the cam follower 102 that are in driven engagement with a toothed rack 120. The rack 120 being operatively associated with a drive means to axially slide the rack within a bore 122 also provided in the engine block B. Thus, as the rack 120 is axially moved, the cam follower 102 will be rotated. The drive means for the rack 120 is likewise operatively associated with the controlling and sensing means 14 illustrated in FIG. 1 which determines the rotary position of the cam follower 102 and oblique surface 110 depending on engine operating conditions.

In operation, the valve tappet mechanism 100 starts from a position wherein the cam follower 102 rides against the cam shaft 15 before engagement with the cam lobe 16. At this time, pressurized fluid is supplied through the supply line 114 above the cam follower 102 to expand the hydraulic link means 106 within bore 108, and to position piston 104 at its operational length position acting against the closed position of an intake valve. As the cam lobe 116 engages the cam follower 102, the cam follower 102 will begin its lifting motion. Shortly thereafter, if not immediately, the outer circumferential surface of the cam follower 102 adjacent the oblique surface 110 will close off the opening 116 of supply line 114 thereby locking the hydraulic means 106 and thus the total length of the valve tappet mechanism 100. Thereafter, the valve tappet mechanism 100 moves through its reciprocal motion to open the intake valve and to start the closing thereof. Next, as the cam follower 102 begins to move inwardly, at some point determined by the rotational position of the oblique surface 110, the opening 116 of supply line 114 will be opened. At this time, the hydraulic link means 106 will collapse forcing hydraulic fluid to backflow in supply line 114. This is accomplished by making sure that the pressure of supply line 114 is sufficient to expand the hydraulic link means 106 and piston 104 to the operational length, while keeping the pressure low enough so that the valve spring will cause a higher pressure in the hydraulic link means 106 during the hydraulic lock condition than is present in the supply line 114. Thus, opening the supply line 114 permits backflow due to the pressure differential. The embodiment of FIG. 2 thus provides for a delayed opening and an early closing directly depending on the rotary position of the oblique surface 110. This is somewhat different than the FIG. 1 embodiment, in that early closing time is only provided; however, both embodiments provide for variable control of the closing timing. The change in opening time or delay thereof is mostly of little consequence in a diesel engine since, diesel engines are not as sensitive to the intake valve opening point. In order to vary the opening and closing time, rack 120 is axially driven to change the orientation of the oblique surface 110 with respect to the position of opening 116.

Referring now to the embodiment shown in FIGS. 3 and 6, a valve tappet mechanism 200 and control system 202 will be described. The valve tappet mechanism comprises, once again, a cam follower 204, a piston 206, and a hydraulic link means 208 between cam follower 204 and piston 206. The valve tappet mechanism 200 being provided within a cylindrical bore 210 in an engine block B of an internal combustion engine. The cylindrical bore 210 and hydraulic link means 208 are fluidically connected to a hydraulic fluid supply line 212 and a drain line 214, so that the supply line 212 and drain line 214 are positioned with respect to the cam follower 204 and piston 206, and reciprocal movement of the cam follower 204 selectively opens and closes supply line 212 by blocking the supply line 212 by the outer cylindrical surface of the cam follower 204. The drain line 214 is maintained in communication with the hydraulic link means 208 during the length of travel of the valve tappet mechanism 200 controlled by cam lobe 16 of cam shaft 15. However, the drain line 214 is selectively opened and closed by an electro-magnetic solenoid 216 that is associated with the control system 202.

The control system 202 includes a multi-lobe distributor cam 218 fixed to rotate with cam shaft 15, a switch mechanism 220, a distributor 222, and a hydraulic fluid pump 224 associated with a reservoir 226. The fluid pump 224 has a pressure regulating valve 228 connected therewith to supply a constant pressure fluid to supply line 212. The multi-lobe distributor cam 218 is used to open and close contacts 230 and 232 of the switch mechanism 220, wherein contact 232 is connected to a power source, while contact 230 is connected to a rotor 234 of the distributor 222. The rotor 234 is rotationally driven at the same speed as the cam shaft 15 so that the rotor 234 electrically connects power to one solenoid 216 of a multi-cylinder internal combustion engine to open a drain line 214 when the solenoid 216 is energized.

Figure 6:
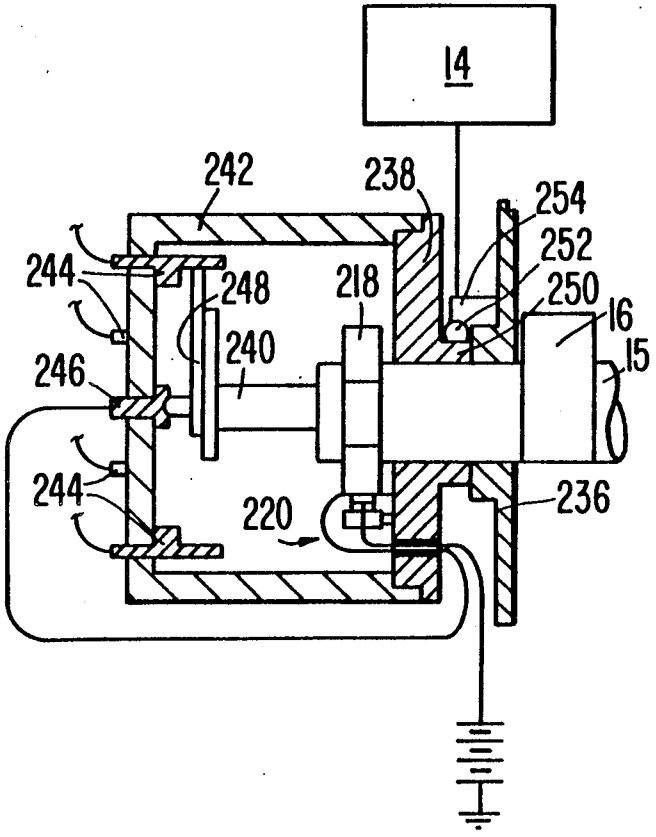
FIG. 6 is a schematic illustration in partial cross section showing a distributor device used in the embodiment of FIG. 3.

As seen in FIG. 6, the distributor cam 218 is preferably fixed to the cam shaft 15 as the cam shaft 15 extends through a fixed cover 236 of the engine and a rotatably mounted plate 238. The rotor 234 is connected to the cam shaft 15 to rotate therewith by a shaft portion 240. A cap 242 is provided with contacts 244 of a like number as there are cylinders of the internal combustion engine each of which are connected to a solenoid 216 associated with a valve tappet mechanism 200 for each cylinder of the internal combustion engine. The rotor 234 is supplied with power from the switch mechanism 220 by a wire passing through the rotatable plate 238 to a central contact 246 and a conductor portion 248 of the rotor 234 extending between central contact 246 and any one of the solenoid contacts 244. In order to change the timing of the early valve closing by opening the drain line 214 with solenoid 216, it is necessary to rotationally move switch mechanism 220 with respect to the engine, without regard to the rotational movement of the distributor cam 218 and cam shaft 15. To do this, the switch mechanism 220 is fixed with the rotary plate 238, which includes a toothed portion 250 surrounding the cam shaft 15 that is rotationally driven by a worm gear 252 associated with a drive means 254. The drive means 254 is further connected to the controlling and sensing means 14 for determining the timing of solenoid energization and collapsing of the hydraulic link means 208 in accordance with engine operating conditions.

The operation of the FIGS. 3 and 6 embodiment is as follows. Before the cam lobe 16 of cam shaft 15 engages the cam follower 204, supply line 212 communicates with the hydraulic link means 208 to expand the valve tappet mechanism 200 to its operational length subject to the closed position of a valve and valve spring thereof. Once the hydraulic link means is expanded, lifting of the cam follower 204 by the lobe 16 closes the supply line 212 thus forming a hydraulic lock between the piston 206 and cam follower 204. The valve tappet mechanism 200 then translates the lifting motion to an intake valve until a point after the maximum lift, when the valve tappet mechanism 200 begins to move inwardly. At any point after the maximum lift, the drain line 214 can be opened by energizing solenoid 216. This occurs, with respect to only a single cylinder, when one lobe of the distributor cam 218 connects contacts 230 and 232 and when the rotor connects that particular solenoid to the switch mechanism 220. Thus, for every single rotation of the cam shaft 15, each solenoid associated with each cylinder and valve tappet mechanism 200 of a multi-cylinder internal combustion engine is energized once during each rotation depending on the rotational position of the switch mechanism 220 with respect to the rotating distributor cam 218. In the embodiment of FIG. 3, a six cylinder internal combustion engine control system is illustrated, wherein six lobes are provided on the distributor cam 218 and six contacts 244 are provided on the distributor cap 242. The order of connection of the solenoids 216 to the contacts 244 along the rotational direction of the rotor 234 are done so as to be in compliance with the firing order of the cylinders of the internal combustion engine, similarly as an ignition spark distributor.

Figure 4:
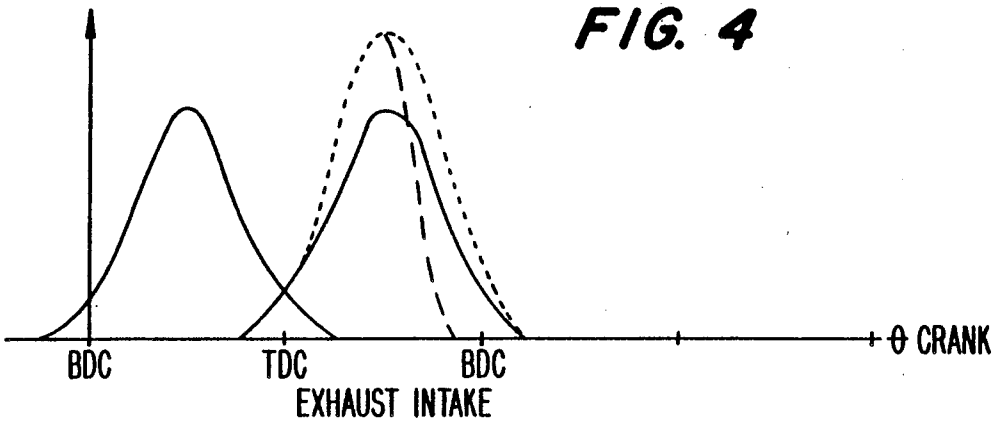
FIG. 4 is a graphical illustration representing the degree of valve opening verses time measured by degrees of the engine crank shaft relating to the embodiments of FIG. 1 and 3.

Referring now to FIG. 4, a graphical illustration is provided comparing time measured by the degree of angular rotation of the engine crank shaft on the abscissa to valve opening degree on the ordinate. The continuous lines represent the opening of an exhaust and intake valve by a conventional cam and tappet of an internal combustion engine. As can be seen, the valves open similarly to one another with the exhaust stroke defined from the BDC position to the TDC position of one engine piston before the intake stroke occurs between the TDC position and BDC position. The dotted line illustrates the path of an intake valve during the intake stroke with an exaggerated cam lobe providing a greater lift and opening of the intake valve which results in more air fuel mixture provided to the engine cylinder Such an exaggerated cam lobe magnifies the fuel consumption and emission control disadvantages set forth earlier by providing large amounts of fuel near the end of the intake stroke. However, in accordance with the present invention, the dashed line indicates such an exaggerated cam used with a valve tappet mechanism designed in accordance with the present invention permitting early closing of the intake valve. By such an arrangement, the area shown under the conventional continuous line is substantially equal to the area under the combination dotted and dashed line from an exaggerated cam with an early closing. Thus, an appropriate amount of air fuel mixture can be obtained thereby while the disadvantages associated with late air fuel mixture are avoided.

Figure 2:
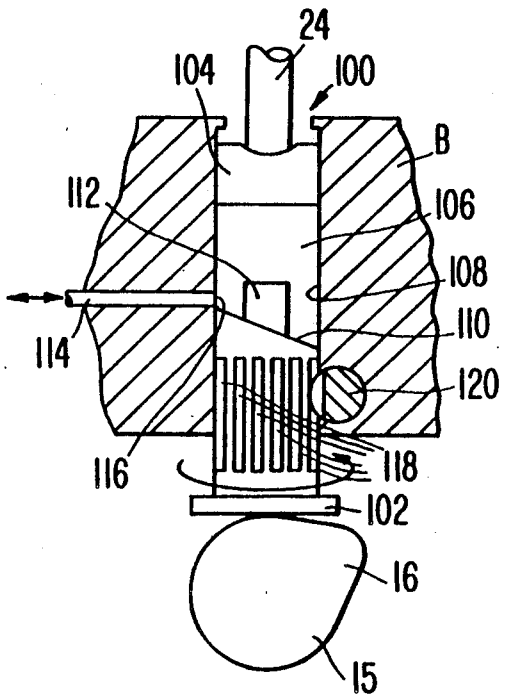
FIG. 2 is a schematic illustration partially in cross section showing a second embodiment of a valve tappet mechanism and control system formed in accordance with the present invention.
Figure 5:
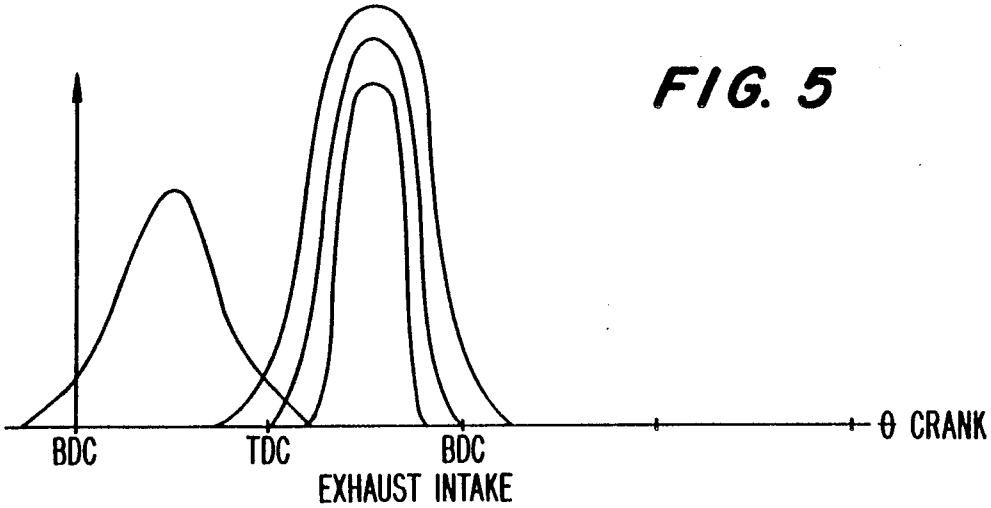
FIG. 5 is a graphical illustration representing valve opening degree verses engine crank shaft time relating to the embodiment of FIG. 2.

Referring now to FIG. 5, another graphical illustration is provided wherein a valve tappet mechanism, as shown in FIG. 2, having delayed opening and early closing together is used. Moreover, the three lines shown between TDC and BDC at the intake timing portion of the graph illustrate the use of three different exaggerated cams, with the two innermost curves including delayed opening and early closing. Likewise as in the FIG. 4 illustration, the area under the curves can be designed in accordance with the area under a normal curve with a normal cam and valve tappet mechanism.

Figure 3:
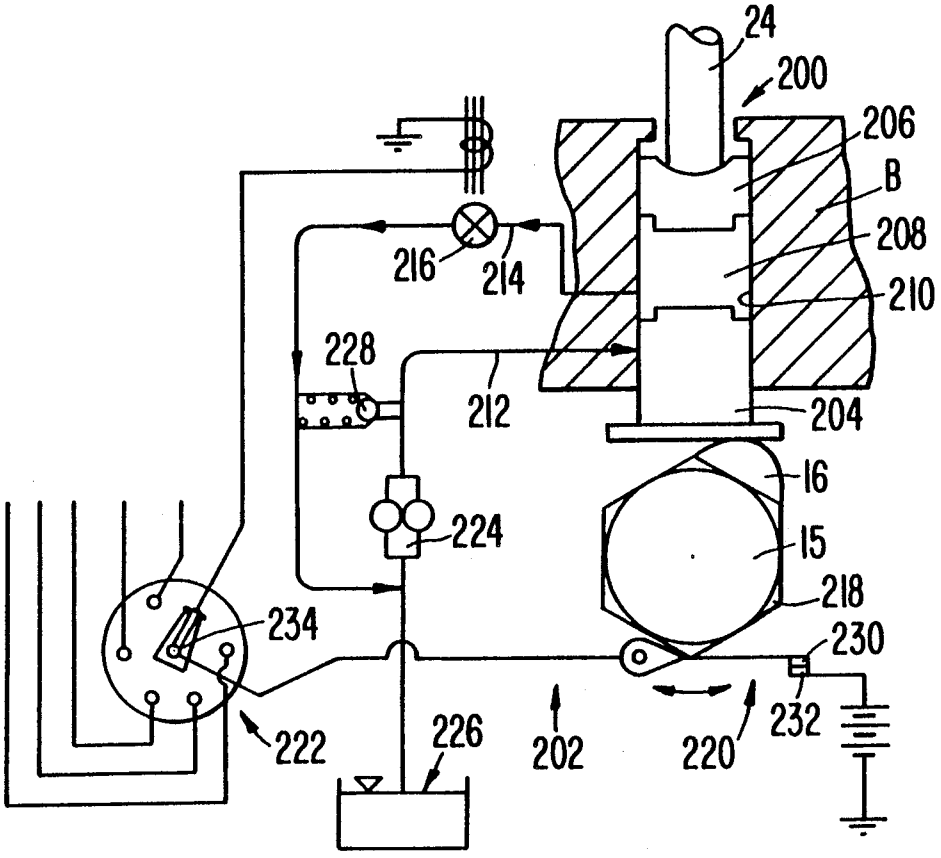
FIG. 3 is a schematic illustration of a third embodiment of a valve tappet mechanism and control system formed in accordance with the present invention.

The embodiments of FIGS. 1, 2 and 3 are each described above with respect to a single engine cylinder, with the understanding that all of the cylinders of an internal combustion engine can be controlled together. For example, in the FIG. 1 embodiment, the fluid gating device 62 is preferably designed to have an axial length sufficient to include as many angled passages as there are cylinders with a supply and dump line for each cylinder. In order for such a combination gating device to work, it is necessary to phase offset the angular passages for each cylinder in accordance with the firing order of the internal combustion engine. As provided, a single adjustment by the means 78 to move the stationary member 66 would result in the common adjustment of the closing times of all of the cylinders by a single adjustment. Moreover, adjustment is facilitated by use of flexible supply and dump lines, wherein the lines only must accommodate a relatively small amount of angular rotation of the stationary member 66 to cover all variations of early valve closing.

In the FIG. 2 embodiment, the rack 120, being driven from a controlled drive means is preferably sufficiently long to extend through an axial bore in the block in a manner to engage each cam follower associated with each cylinder. Thus, axial displacement results in a like rotational movement of each of the cam followers 102. In this case, it is important that the cam followers 102 be accurately aligned when assembled in a common orientation of the oblique surface 110. In the FIG. 3 embodiment, the distributor mechanism 222 and rotor 234 already provides for successive energization of solenoids 216 for each cylinder of the internal combustion engine. Once again, one simple adjustment of the rotary position of switch mechanism 220 results in common adjustment and variation of closing times of all of the cylinders of the internal combustion engine.

Thus, it will be noted that an improved valve tappet mechanism and control system is provided wherein the closing time of an engine valve can be varied over a relatively wide range of closing time, that can occur at any position after the maximum lift is obtained with a minimum of elements that also accurately determine the expanded operational position of each valve tappet mechanism.

INDUSTRIAL APPLICABILITY

While the valve tappet mechanism and control system is described herein in its most useful application to an internal combustion engine, it is important to note that such an expansible and collapsible valve tappet mechanism can be used to control timed opening and closing of intake valves or exhaust valves of an internal combustion engine, whether a diesel engine or gas engine, and that such application can be extended to industrial type internal combustion engines as well as simple single cylinder motors.

I claim:

1. A valve tappet mechanism and control system for use in an internal combustion engine comprising:

a cam shaft including at least one lobe with a valve opening surface and a valve closing surface rotationally mountable within an internal combustion engine:

a valve reciprocably slidable within an internal combustion engine;

tappet means positioned between said cam shaft and said valve to open and close said valve in accordance with said valve opening and valve closing surfaces of said lobe, said tappet means including a cam follower and a piston connected by a hydraulic link means for providing an operational length to said tappet means with said hydraulic link means in an extended position and a collapsed length with said hydraulic link means collapsed, said cam follower operatively positioned to ride on said cam shaft, and said piston operatively connected to said valve;

pressurization means for permitting supply and drainage of hydraulic fluid to and from said hydraulic link means, for expanding said hydraulic link means and said tappet means to said operational length and for collapsing said hydraulic link means and said tappet means to said collapsed length;

timing control means for controlling said pressurization means to expand said tappet means to said operational length for at least a portion of the time that said cam follower rides on said valve opening surface and to collapse said hydraulic link means and said tappet means at an early closing time when said cam follower rides on said valve closing surface;

variable means for determining said early closing time taking into account engine operating conditions; and an axial internal cavity within which said piston is axially slidable, an annular chamber at an inwardmost end of said internal cavity that is radially wider than said internal cavity, an axial groove on an external surface of said cam follower in communication with said fluid line, and an opening connecting said annular chamber to said axial groove, wherein said axial groove extends axially on said cam follower for a distance at least equal to a stroke distance of said tappet means.

2. The valve control system of claim 1, wherein said pressurization means includes a fluid line in communication with said hydraulic link means, and said fluid line permits fluid flow to and from said hydraulic link means.

3. The valve control system of claim 2, wherein said fluid line is connected to a fluid pump to supply pressurized fluid, and said fluid line is further connected to said timing control means comprising a fluid gating means connected to said fluid line for further connecting said fluid line to a dump line at said early closing time to collapse said hydraulic link means.

4. A valve control system of claim 1, wherein said cam follower further includes a transverse groove on said innermost end of said internal cavity.

5. The valve control system of claim 3, wherein said fluid gating means includes a rotary valve with a passageway therethrough and a stationary member having means to couple said fluid line and said dump line thereto at discreet locations and to permit fluid passage therethrough, and said variable means comprises a rotary means to rotationally move said stationary member.

6. A valve tappet mechanism and control system for use in an internal combustion engine comprising:

a cam shaft including at least one lobe with a valve opening surface and a valve closing surface rotationally mountable within an internal combustion engine:

a valve reciprocably slidable within an internal combustion engine:

tappet means positioned between said cam shaft and said valve to open and close said valve in accordance with said valve opening and valve closing surfaces of said lobe, said tappet means including a cam follower and a piston connected by a hydraulic link means for providing an operational length to said tappet means with said hydraulic link means in an extended position and a collapsed length with said hydraulic link means collapsed, said cam follower operatively positioned to ride on said cam shaft, and said piston operatively connected to said valve;

pressurization means for permitting supply and drainage of hydraulic fluid to and from said hydraulic link means and for expanding said hydraulic link means and said tappet means to said operational length and collapsing said hydraulic link means and said tappet means to said collapsed length, said pressurization means including a fluid line in communication with said hydraulic link means;

timing control means connected to said fluid line for controlling said pressurization means to expand said tappet means to said operational length for at least a portion of the time that said cam follower rides on said valve opening surface and to collapse said hydraulic link means and said tappet means at an early closing time when said cam follower rides on said valve closing surface, said timing control means including a fluid gating means for further connecting said fluid line to a dump line at said early closing time to collapse said hydraulic link means, said fluid gating means including a rotary valve means for coupling said fluid line and said dump line to permit fluid passage from said fluid line to said dump line; and variable means for determining said early closing time taking into account engine operating conditions.

7. A valve control system of claim 6, wherein said rotary valve means further includes a rotary valve and a stationary member having means to couple said fluid line and said dump line thereto at discreet locations and to permit fluid passage therethrough and a rotary means to rotationally move said stationary member.

8. The valve control system of claim 7, wherein said rotary means comprises a stepper motor with a worm gear that rotates the stationary member by teeth provided on an external surface of said stationary member.

9. The valve control system of claim 8, wherein said fluid gating means connects a plurality of fluid lines to a like plurality of dump lines by a single rotary valve having a like plurality of passageways therethrough, with each passageway connected to a like number of valve tappet mechanisms by the fluid lines of a like number of cylinders of a multi-cylinder internal combustion engine.

10. An internal combustion engine having at least one cylinder with a reciprocable piston therein, further comprising:

a cam shaft including at least one lobe with a valve opening surface and a valve closing surface rotationally mounted within said internal combustion engine;

an intake valve reciprocably slidably provided with said internal combustion to open and close an intake passage to said at least one cylinder;

tappet means positioned between said cam shaft and said valve to open and close said valve in accordance with said valve opening and valve closing surfaces of said lobe, said tappet means including a cam follower and a piston connected by a hydraulic link means for providing an operational length to said tappet means with said hydraulic link means in an extended position and a collapsed length with said hydraulic link means collapsed, said cam follower operatively positioned to ride on said cam shaft, and said piston operatively connected to said valve;

pressurization means for permitting supply and drainage of hydraulic fluid to and from said hydraulic link means, for expanding said hydraulic link means and said tappet means to said operational length and for collapsing said hydraulic link means and said tappet means to said collapsed length;

timing control means for controlling said pressurization means to expand said tappet means to said operational length for at least a portion of the time that said cam follower rides on said valve opening surface and to collapse said hydraulic link means and said tappet means at an early closing time when said cam follower rides on said valve closing surface;

variable means for determining the early closing time depending on engine operating conditions; and an axial internal cavity with which said piston is axially slidable, an annular chamber at an inwardmost end of said internal cavity that is radially wider than said internal cavity, an axial groove on an external surface of said cam follower in communication with said fluid line, and an opening connecting said annular chamber to said axial groove, wherein said axial groove extends axially on said cam follower for a distance at least equal to a stroke distance of said tappet means.

11. The internal combustion engine of claim 10, wherein said cam follower further includes a transverse groove on said innermost end of said internal cavity.

12. The internal combustion engine of claim 10, wherein said pressurization means includes a fluid line in communication with said hydraulic link means, and said fluid line permits fluid flow to and from said hydraulic link means, further wherein said fluid line is connected to a fluid pump to supply pressurized fluid and said fluid line is further connected to said timing control means comprising a fluid gating means said fluid line for further connecting said fluid line to a dump line a said early closing time to collapse said hydraulic link means.

13. The internal combustion engine of claim 12, where said fluid gating means includes a rotary valve with a passageway therethrough and a stationary member having means to couple said fluid line and said dump line thereto at discreet locations to permit fluid passage therethrough, and said variable means comprises a rotary means to rotationally move said stationary member.

14. The internal combustion engine of claim 13, wherein said fluid gating means connects a plurality of fluid lines to a like plurality of dump lines by a single rotary valve having a like plurality of passageways therethrough, with each passageway connected to a like number of valve tappet mechanisms by the fluid lines of a like number of cylinders of said internal combustion engine.

* * * * *